US005331704A

United States Patent [19]

Rosen et al.

[11] Patent Number: 5,331,704

[45] Date of Patent: Jul. 26, 1994

[54] MULTI-PURPOSE TOOTHBRUSH

[76] Inventors: Sidney W. Rosen, #1 Glens Dr. East, Boynton Beach, Fla. 33436; Jeffrey Ganeles, 2365 NW. 46 St., Boca Raton, Fla. 33431

[21] Appl. No.: 60,115

[22] Filed: May 12, 1993

[51] Int. Cl.[5] ..... A47L 13/12; A46B 9/04

[52] U.S. Cl. ..... 15/106; 15/167.1; D4/106

[58] Field of Search ..... 15/106, 167.1, 167.2, 15/110, 143 R, 160; D4/105, 106, 119, 120

[56] References Cited

U.S. PATENT DOCUMENTS

| | | | |
|---|---|---|---|
| D. 26,215 | 10/1896 | Keepe | D4/120 |
| D. 75,971 | 8/1928 | Faubert | D4/106 |
| D. 104,029 | 4/1937 | Gray | 15/160 |
| D. 213,669 | 4/1969 | Miller | D4/106 |
| 165,236 | 7/1875 | Jenness | 15/110 R |
| 188,242 | 3/1877 | Goldsmith | 15/143 R |
| 376,879 | 1/1888 | Gustafson | 15/143 R |
| 469,633 | 2/1892 | Goodman | 15/143 R |
| 1,696,433 | 12/1928 | Faubert | 15/167.1 |
| 2,190,277 | 2/1940 | Viragh | 15/106 |
| 2,206,542 | 7/1940 | Arnold | 15/106 |
| 2,807,820 | 10/1957 | Dinhofer | 15/110 |
| 4,670,931 | 6/1987 | Abbassi | 15/106 |

FOREIGN PATENT DOCUMENTS

| | | | |
|---|---|---|---|
| 0475314 | 3/1992 | European Pat. Off. | 15/171 |
| 0365826 | 4/1939 | Italy | 15/167.1 |
| 0124048 | 3/1919 | United Kingdom | 15/167.1 |
| 0476186 | 12/1937 | United Kingdom | 15/106 |

*Primary Examiner*—Stephen F. Gerrity
*Assistant Examiner*—Randall E. Chin
*Attorney, Agent, or Firm*—John J. Byrne

[57] ABSTRACT

A bifurcated toothbrush having two brush carrying members angled with respect to one another at the working end of the toothbrush handle. Each brush is designed for a distinct purpose and the brushes are spaced at a sufficient distance from one other to move the cheek or tongue away from the surface being brushed.

3 Claims, 1 Drawing Sheet

MULTI-PURPOSE TOOTHBRUSH

BACKGROUND OF THE INVENTION

Most toothbrushes of the prior art include one handle and one brush. There have been variations on both the handle and their brushes. For example, prior art inventors have suggested curved and angled handles. They have also advanced other toothbrushes of varied shapes and designs. In more recent times, hygienist and dentist groups have recognized the inadequacies of prior art brushes. For instance many brushes do not properly access all difficult to reach areas for total teeth cleaning and gum massage. Because of these needs, brushes with cone shape bristles, some with straight or angled handles, and other variations in brushes have been presented to the public. However, most users resist using more than one brush for a single cleansing.

The present invention relates to a toothbrush that improves access to the subgingival and interproximal areas of teeth in inaccessible but frequently diseased areas of the mouth. This aids in plaque removal. A further functional property of the brush is that it provides the user with improved visibility of the buccal surfaces of the molars by lifting the cheek laterally and posteriorly out of the way during use. The brush utilizes the anatomy of the teeth, oral structures and the ergonomics and habits of adults during home oral hygiene procedures.

FIELD OF INVENTION

This invention relates to a single toothbrush that can accomplish a plurality of periodontal functions while maintaining a design of type that does not inconvenience the user and is adaptable for storage in the same manner as conventional prior art toothbrushes.

An important objective of this invention is to provide means to accomplish a plurality of functions using a single brush. In the normal bathroom vanity, there is a fixture to hang toothbrushes of conventional design. Many of these fixtures have apertures slightly larger than the cross-sectional dimension of the toothbrush handle and smaller than the brush area.

Dual purpose brushes, such as those having a different type brushes or tips at either end cannot be stored in such devices. Therefore, a principle objective of this invention to provide a dual purpose brush that can be stored in conventional toothbrush racks. Another objective of this invention is to provide two separate brushes with different functions at the same end of a common handle. Thus, with a conventional toothbrush to one that can reach previously inaccessible areas simple change in grip the user can convert the instrument from a brush to a gum stimulator.

The dental profession accepts the fact that bacterial plaque is the major etiologic agent in gingivitis, periodontitis and dental cavities. It is further acknowledged that complete daily mechanical plaque removal is the most effective way to maintain dental and gingival health. The present invention has as a further objective, a more complete plaque removal from all tooth surfaces using a single device.

The invention provides for a conventional large brush and a smaller conical brush on opposite sides of a common brush handle. This "two headed" toothbrush has a "Y" configuration. The design improves the user's ability to effectively clean more of the surfaces of the teeth. The handle portion of the brush, opposite the brush end, has no protrusions or attachments that prevent the user from storing it in a traditional bathroom toothbrush holder or fixture. The brush configuration of this invention has several advantages in tooth cleaning ability by allowing access to tooth surfaces usually blocked by the cheek and tongue, notably the lingual surfaces of the lower teeth. The smaller brush is specially designed to clean between teeth, particularly when the user has had recession or shrinkage of the gums. This frequently occurs in adults naturally or as the result of periodontal defects. Finally, the "Y" shape configuration can lift the user's cheek away from the back teeth during brushing. This also allows visual access of the molar teeth and adjacent gums during brushing to insure increased or complete plaque removal from the back teeth which are most often attacked by dental disease.

Other objectives of this invention, not at this time particularly enumerated, will be understood from the following description and the illustrative embodiment of the invention shown in the accompanying drawings.

DETAILED DESCRIPTION OF THE PREFERRED EMBODIMENT

Figure 1:
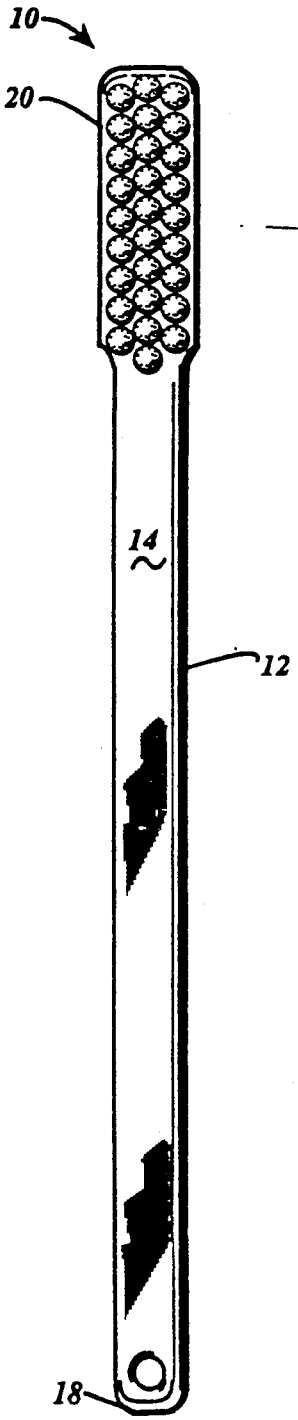
FIG. 1 is a top plan view.

Referring now to the drawing wherein like numerals indicate like parts, the numeral 10 generally indicates the brush of this invention. The brush 10 has an elongated handle 12 having an upper surface 14 and a lower surface 16 parallel thereto. The handle 12 is planar and it can further be said to have a distal end 18 and a working end 20.

Figure 2:
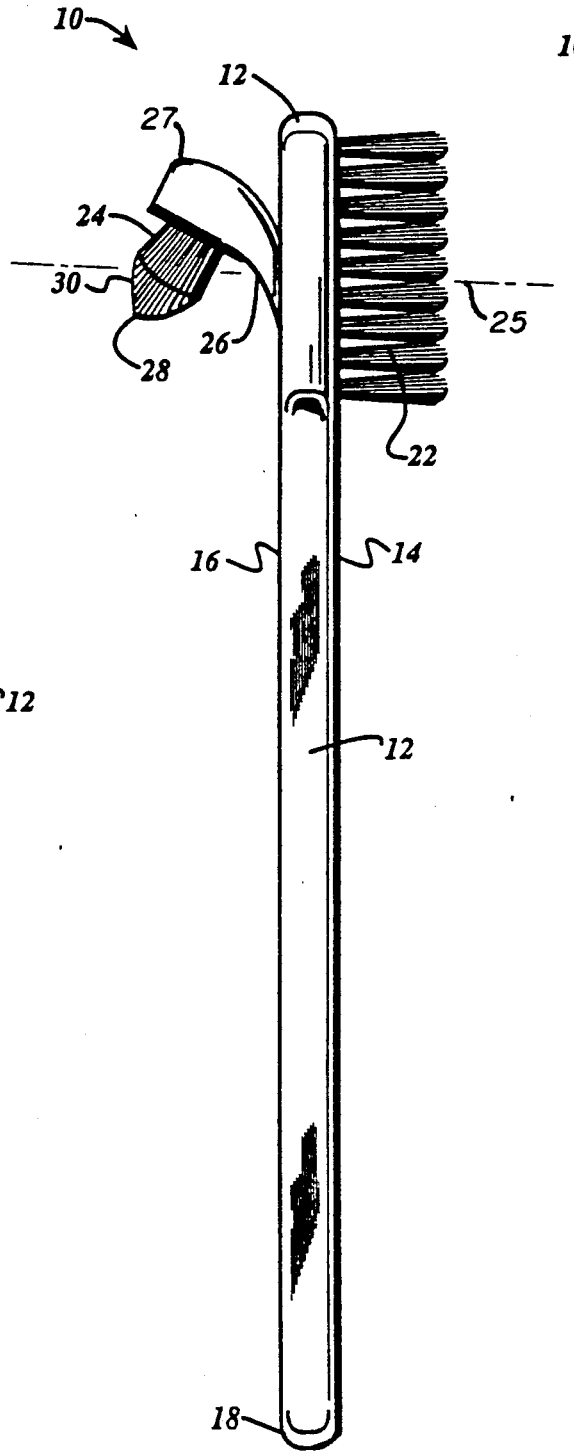
FIG. 2 is a side elevation of the device shown in FIG. 1.
Figure 3:
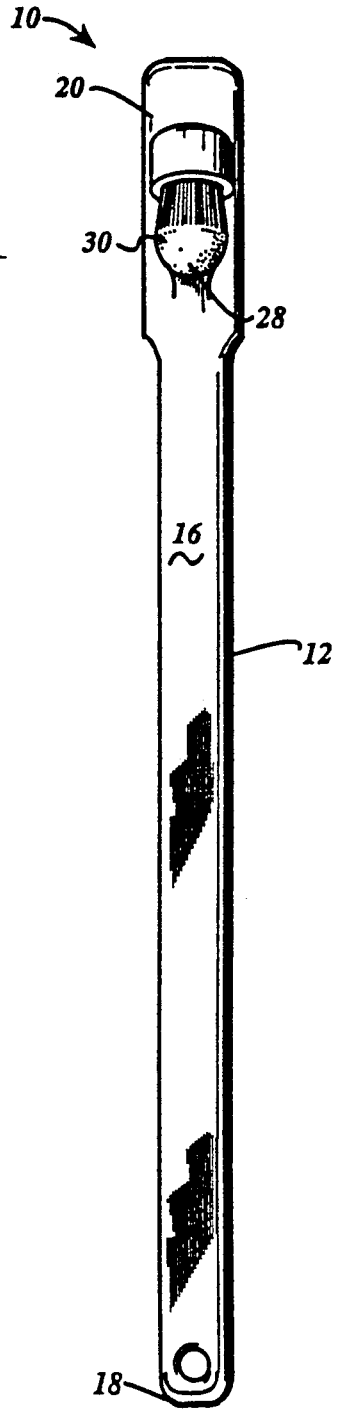
FIG. 3 is a bottom plan view thereof.

A brush 22 is formed on the upper surface 14 at the working end. Brush 22 is multi-bristled and is designed primarily to clean the occlusal, facial and lingual surfaces of the teeth. This larger brush head 22 is designed with bristles for sulcular brushing of the facial surfaces of the upper and lower teeth. Brush head 22 of a generally rectangular pattern will also be used to scrub the occlusal surfaces of the posterior teeth. As is conventional in toothbrushes, the brush 22 covers less than 25% of the length of the handle as seen in FIGS. 1 and 2. It will effectively clean these surfaces using any of the commonly employed brushing methods including sulcular, roll and modified Bass techniques. Because of anatomical considerations, the brush 22 does not adequately clean the lingual surfaces of the lower teeth or behind the most posterior teeth. Also, the user is inhibited from performing good home care to the molars because of lack of direct visibility.

A second brush 24 is provided to clean these lingual surfaces and the difficult to reach surfaces of the posterior teeth. Brush 24 is carried by a member 26 that angles outwardly from the surface 16 at about 30 degrees from handle 12 in a manner to carry brush 24 "below" brush 22 and approximately mid-way of its length the axes of the bristles of brush 24 form an acute angle with the axis of handle 12 and an obtuse angle with the bristles of brush 22. The bristles of brush 24 are directed rearwardly toward distal end 18. Member 26 is formed with a smooth surface 27.

The smaller circular brush head 24 has approximately 25% of the bristles of the head 22 and is fused to the angled shaft 26 at approximately 30 degrees. The bristles are in a tapered arrangement so that the filaments in the center 28 of the brush are longer than at the circumferential area 30 to thereby form a conical surface. The brush 24 is designed to reach the mandibular lingual and interproximal surfaces and the distal surfaces of the most posterior teeth. Note that a plane 25, parallel to the bristles of brush 22 and midway of its length, intersects the brush 24 and is also especially effective for cleaning bifurcation areas of molars. The angulation of member 26 allows the user to gain straight line access to thee difficult to reach surfaces. Brushes of the conical type are sometimes used after periodontal treatment to ensure plaque removal from teeth with particularly difficult access. The member 26 has a smooth surface as shown by numeral 27.

The "Y" configuration has several distinct advantages. First, by delivering the small end of the tooth brush to the mouth at the proper angulation, the plaque removing ability of this brush head is enhanced. Second, when using the large end of the toothbrush while cleaning the posterior teeth, the user's lip can be gently hooked by the bifurcation between the brushes to lift the lip posteriorly and laterally out of the line of sight. This allows the user to clearly see the teeth, gingiva and action of the toothbrush. This facilitates more effective plaque removal from the back teeth—areas that are routinely neglected. Finally, the handle or long stem of the "Y" is of a standard dimension for toothbrushes. This insures that this two headed brush can be placed and stored in an ordinary bathroom toothbrush holder.

There has been described a two headed tooth brush with many advantages which is user friendly. The brush does not interfere with the dental care routines and habits of most people. There is still a single handle that, although providing multi-purpose brushes fits conveniently into conventional toothbrush holders and does not take additional slots in bathroom fixtures.

While there has been disclosed an effective and efficient embodiment of the invention, it should be well understood that the invention is not limited to such an embodiment as there might be changes made in the arrangement, disposition and form of the parts without departing from the principle of the present invention as comprehended within the scope of the accompanying claims.

I claim:

1. A multi-purpose toothbrush comprising:

an elongated handle having an upper surface and a bottom surface and said handle having a working end and a distal end;

a first relatively flat multi-bristled brush fused to said upper surface at said working end and covering less than 25% of the length of said elongated handle;

a member angled outwardly from said bottom surface and said member having an outer end;

a second brush carried by said member at said outer end and having substantially fewer bristles than said first brush;

said member being attached to said bottom surface at a region of said bottom surface including a plane perpendicular to said handle, which plane is transverse said first brush mid-way of its length, and;

said bristles of said first brush being parallel to said plane and said bristles of said second brush are at an acute angle to said plane and free ends of the bristles of the second brush point toward said distal end of said handle.

2. The invention of claim 1 wherein said bristles of said first brush form a generally rectangular pattern and said bristles of said second brush form a generally circular pattern.

3. The invention of claim 2 wherein said outer end of said member has a smooth surface.

* * * * *